United States Patent [19]

Lindell

[11] 4,345,724

[45] Aug. 24, 1982

[54] LIGHTWEIGHT REEL

[75] Inventor: Willard G. Lindell, Maple Park, Ill.

[73] Assignee: The Anaconda Company, Denver, Colo.

[21] Appl. No.: 162,002

[22] Filed: Jun. 23, 1980

[51] Int. Cl.[3] ..... B65H 75/22

[52] U.S. Cl. ..... 242/115; 242/170; 206/400; 206/517

[58] Field of Search ..... 242/115, 116, 94, 86.4, 242/77, 77.2, 77.3, 77.4, 117, 118.4, 118.5, 118.6, 118.61, 118.62, 170; 206/390, 398, 400, 517, 515

[56] References Cited

U.S. PATENT DOCUMENTS

| | | | |
|---|---|---|---|
| 1,036,644 | 8/1912 | Kilmer et al. | 242/118.6 |
| 1,254,091 | 1/1918 | Trudelle | 242/118.6 |
| 1,333,162 | 3/1920 | Cook, Jr. | 242/77.2 |
| 1,819,337 | 8/1931 | Pevear | 242/77.3 |
| 1,915,825 | 6/1933 | Hescock | 242/77.4 |
| 2,726,050 | 12/1955 | Jones | 242/77 |
| 2,932,388 | 4/1960 | Hartsfield, Jr. | 242/170 X |
| 4,029,206 | 6/1977 | Mykleby | 206/400 |

FOREIGN PATENT DOCUMENTS

| | | | |
|---|---|---|---|
| 2439488 | 2/1975 | Fed. Rep. of Germany | 242/115 |

*Primary Examiner*—John M. Jillions

*Attorney, Agent, or Firm*—Allegretti, Newitt, Witcoff & McAndrews

[57] ABSTRACT

A lightweight, readily assembled and disassembled reel for transporting and dispensing material such as flexible tubing or electrical conduct or is disclosed. The reel comprises a pair of flanges, each flange having connected thereto a plurality of spaced apart tubes. The tubes attached to each flange detachably connect with the opposite flange to provide, when connected, a support surface between the flanges for the material being transported and, when disconnected, the ability to be superimposed or stacked on each other for compact storage and shipment. Preferably, a flexible sheet of sheet metal, cardboard, fiberboard or the like is placed over the tubes and/or flange surfaces to protect the material placed on the reel during shipment.

3 Claims, 7 Drawing Figures

Fig. 3
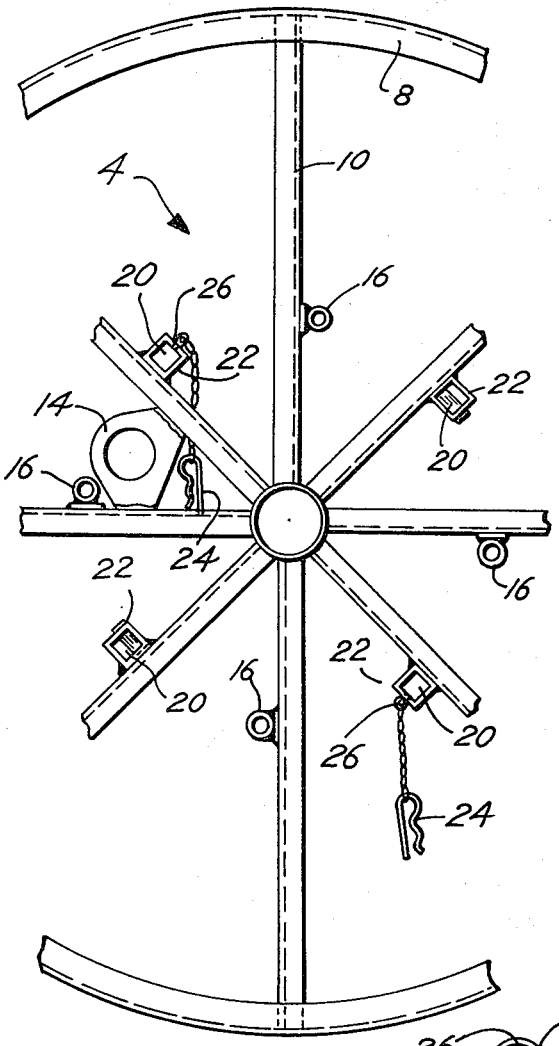
Fig. 4
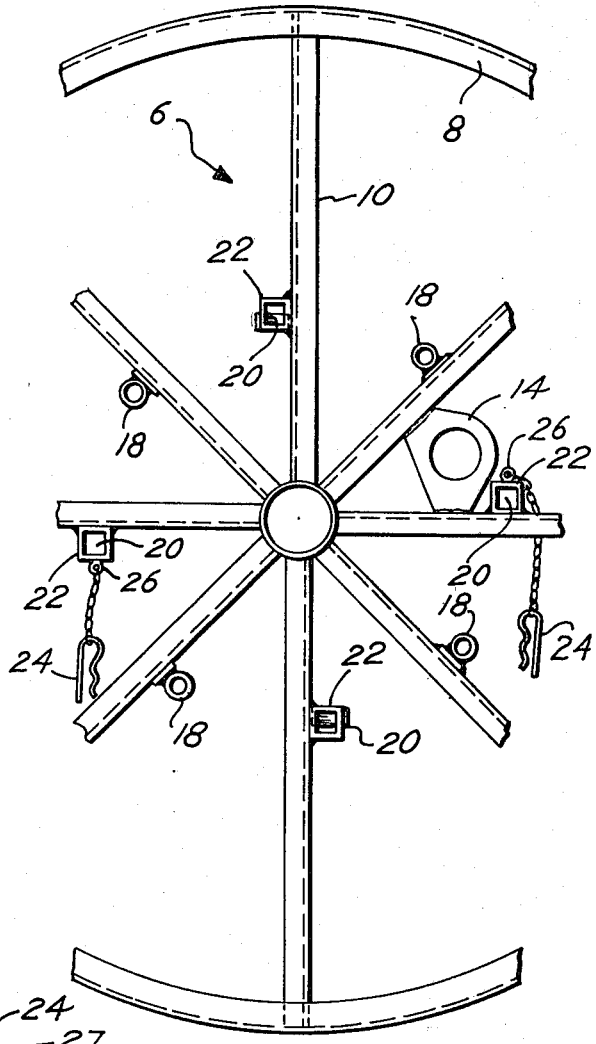
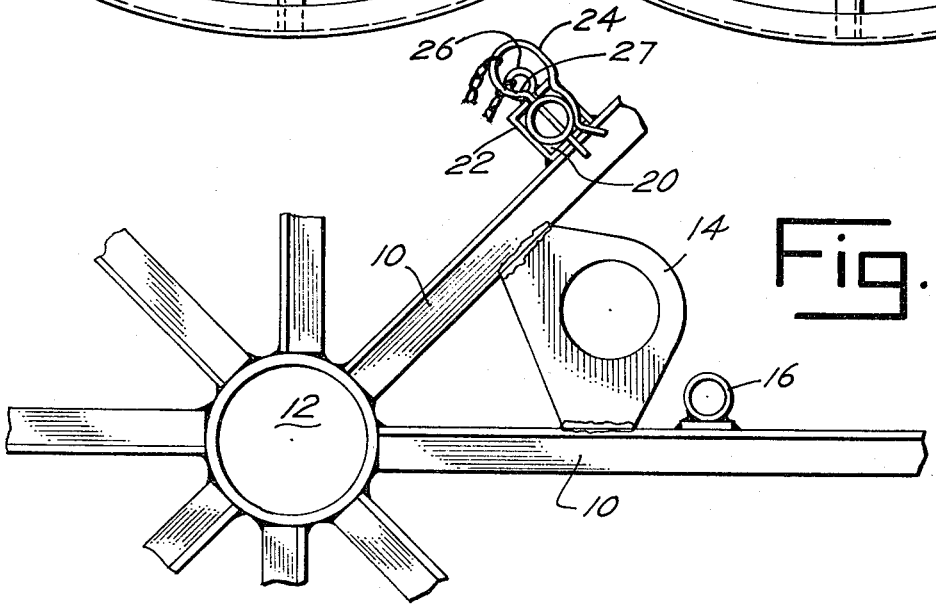
Fig. 5

LIGHTWEIGHT REEL

BACKGROUND OF THE INVENTION AND DESCRIPTION OF THE PRIOR ART

The present invention relates to reels, particularly lightweight, readily assembled and disassembled metal reels for transporting and dispensing material such as tubing and electrical conductor and other objects in long or continuous lengths.

Reels for transporting electrical conductor to a site for use have traditionally included expensive, relatively heavy metal or wooden reels having a diameter of about 36–60 inches. Because of their expense, the customer was required to place a reel deposit with the wire manufacturer to insure that the reels would be returned for reuse. In adddition, the traditional returnable metal or wooden reels, because of the nature of their construction, must be returned intact to the cable manufacturer. Although the flanges of the empty reels permit some overlap during storage, the volume required to ship the reels back to the cable manufacturer is substantially identical to the volume of the reel when filled with cable. As a result, expensive freight and handling charges are incurred in returning the reels.

In recognition of the expense associated with the manufacture and return shipping of the heavy-duty metal and wooden reels, the prior art developed less expensive, less durable, non-returnable wooden reels. These reels differ little in construction from the returnable wood variety except that they were constructed from less quality and amounts of material to lower their cost. These non-returnable reels were simply discarded when empty since the cost of a new non-returnable reel did not justify the expense of returning a used reel. Proposed ecological legislation in certain states, however, has made the use of the non-returnable reels not reasonable.

The prior art has also attempted to produce collapsible, returnable reels to ship and dispense wire cable. Baker Industries, Hartselle, Ala. has manufactured and sold a knowk down type shipping T-reel for shipping electrical cable. The Baker knock down reel comprises two heavy metallic flange portions detachably connected to a center drum section formed by two heavy metallic semi-cylindrical sleeves. Although these Baker reels were theoretically of the knock down type, they were still of the same relative heavy weight as a traditional metal reel. As a result, many of these reels could not be readily assembled and disassembled and the component parts moved by a single worker. Rather, at least two people were required to assemble the reel because of the large weight involved in not only the reel as a whole but in its component parts.

Mossberg-Hubbard of Cumberland, Rhode Island has manufactured a 48 inch diameter reel having a pair of flanges detachably connected to a unitary cylindrica center drum. Although this structure permitted the manufacture of a lighter weight reel, which could be partially dismantled for return shipment, the volume occupied by the cylindrical center drum still required an appreciable shipping volume resulting in some but not a substantial cost savings in shipment.

SUMMARY OF THE INVENTION

It is an object of this invention to provide a lightweight, readily assembled and disassembled reel for transporting and dispensing material such as electrical conductor, particularly reels having a diameter of 36–60 inches.

It is a further object of this invention to provide a reel for transporting and dispensing material which can be quickly and easily assembled and disassembled by a single person.

It is a specific object of this invention to provide a lightweight reel which can be readily disassembled into a minimum number of component parts wherein the component parts can be stored in a relatively small space for return to the manufacturer for refill.

In accordance with the present invention, these objects are achieve by providing a lightweight reel for transporting and dispensing a material such as plastic tubing or electrical conductor which can be easily assembled or disassembled by a single person and which, when disassembled, has only two component parts. This reel assembly comprises two separate flange portions, each having attached thereto a plurality of elongated support members such as metallic tubing. Preferably each flange portion is circular in shape and has a center hub portion and an outer rim portion interconnected to the hub portion by a plurality of spokes wherein the elongated support members are connected to the spokes at a point intermediate the hub and the rim. The reel is assembled by quickly and detachably connecting the free end of the elongated support members of one flange portion to an appropriate fitting or opening on another flange portion.

In addition, the elongated support members are positioned relative to each other on each flange portion to provide, when assembled, a support surface between the two flange portions for the material being transported, and, when disconnected, the ability to be suprimposed or stacked on each other for compact storage and shipment.

The inside surfaces of the flange portions and the support surface provided by the elongated support members can also be covered, where necessary, with a suitable covering to protect the material being transported from being unduly bent or kinked. A preferred covering material is an ecologically acceptable, recycleable material such as cardboard or flexible fiberboard.

Other objects and embodiments of the present invention will be found by reference to the following detailed description of the invention.

BRIEF DESCRIPTION OF THE DRAWINGS

FIG. 3 is a cross sectional view of the first portion of the reel assembly taken alon section line 3—3 of FIG. 2.

FIG. 4 is a cross sectional view of the second portion of the reel assembly taken along section line 4—4 of FIG. 2.

FIG. 5 is a detailed end view of the first portion of the reel assembly illustrating the interconnection of the tubing to the flange portions of the reel as illustrated in FIG. 3 as viewed from the opposite direction.

DETAILED DESCRIPTION OF PREFERRED EMBODIMENT

Figure 1:
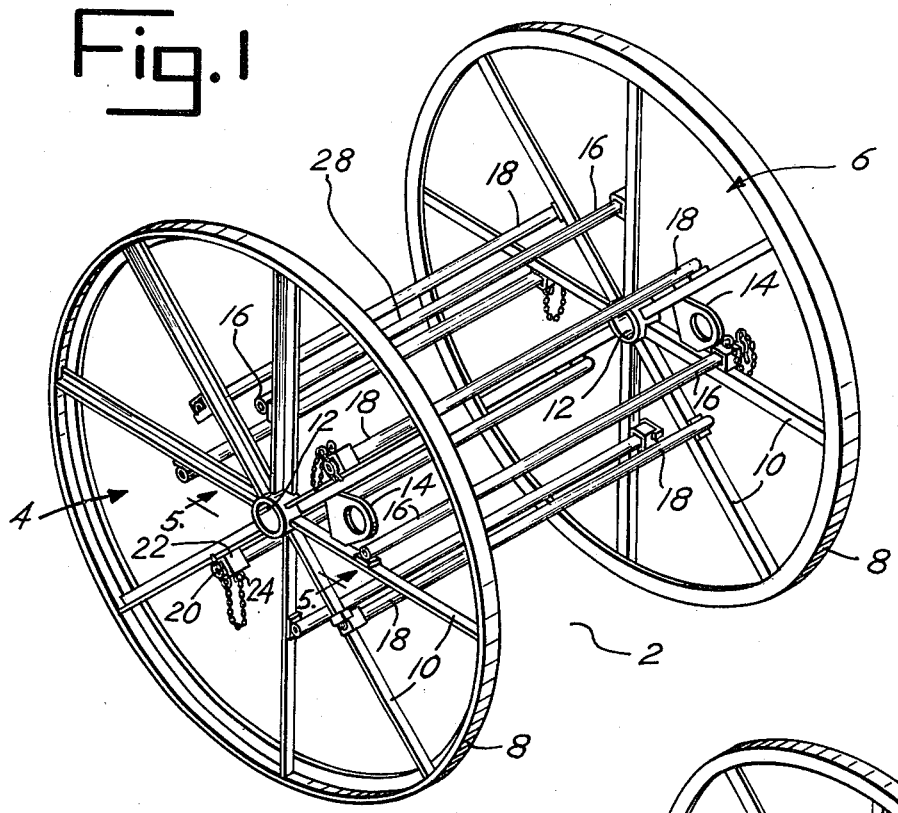
FIG. 1 is a complete assembly view of a preferred embodiment of a lightweight, readily assembled and disassembled reel for transporting electrical conductor in accordance with the present invention.

Referring to FIGS. 1–7, there is illustrated a 42 inch diameter lightweight metallic reel assembly 2 for transporting and dispensing 600 volt aluminum URD electrical conductor cable. Although the specific reel 2 illustrated in FIGS. 1–7 was specifically designed for utilization with aluminum wire cable, the reel assembly of the present invention can be utilized in conjunction with any continuous or extruded product of long lengths that is traditionally dispensed from a reel assembly having a diameter of about 36–60 inches. For example, the reel assembly of the present inventio can be utilized to dispense and transport tubing and other continuous extruded materials as well as electrical conductor.

Referring first to FIGS. 1–5, there is illustrated reel assembly 2 comprising first side flange member 4 and second side flange member 6. First side flange 4 and second side flange 6 are manufactured from conventional angle ion to provide a circular rim portion 8, a central hub portion 12, and a series of spokes 10 interconnecting the hub 12 with the circular rim 8. A conventional drive or doghole 14 to turn reel assembly 2 when hub 12 is mounted on support bracket (not shown) is positioned between spokes 10.

As indicated, flange assemblies 4 and 6 are manufactured from conventional angle iron. It is possible, however, to manufacture the flange assemblies from other materials of construction such as U-shaped channel, round tubes or pipes.

Tubes or pipes 16 are permanently affixed by being welded perpendicular to alternate spokes 10 of first side flange assembly 4. Smilarly, pipes or tubes 18 are permanently affixed by being welded perpendicular to alternate spokes 10 of second side flange assembly 6 at a point intermediate hub 12 and rim 8.

As indicated, tube members 16 and 18 are welded or otherwise permenently attached to alternate spokes of first side flange assembly 4 and second side flange assembly 6, respectively. A bracket assembly 22 shaped to provide an opening 20 of sufficient size to receive the free end of one of the two tubes 16 or 18 is positioned on those spokes to which a tube is not permanently affixed. In addition, the free end of tubes 16 and 18 are provided with a central opening 26 perpendicular to the axis of the tube so as to align with opening 27 in bracket 22 to facilitate assembly and disassembly.

Figure 2:
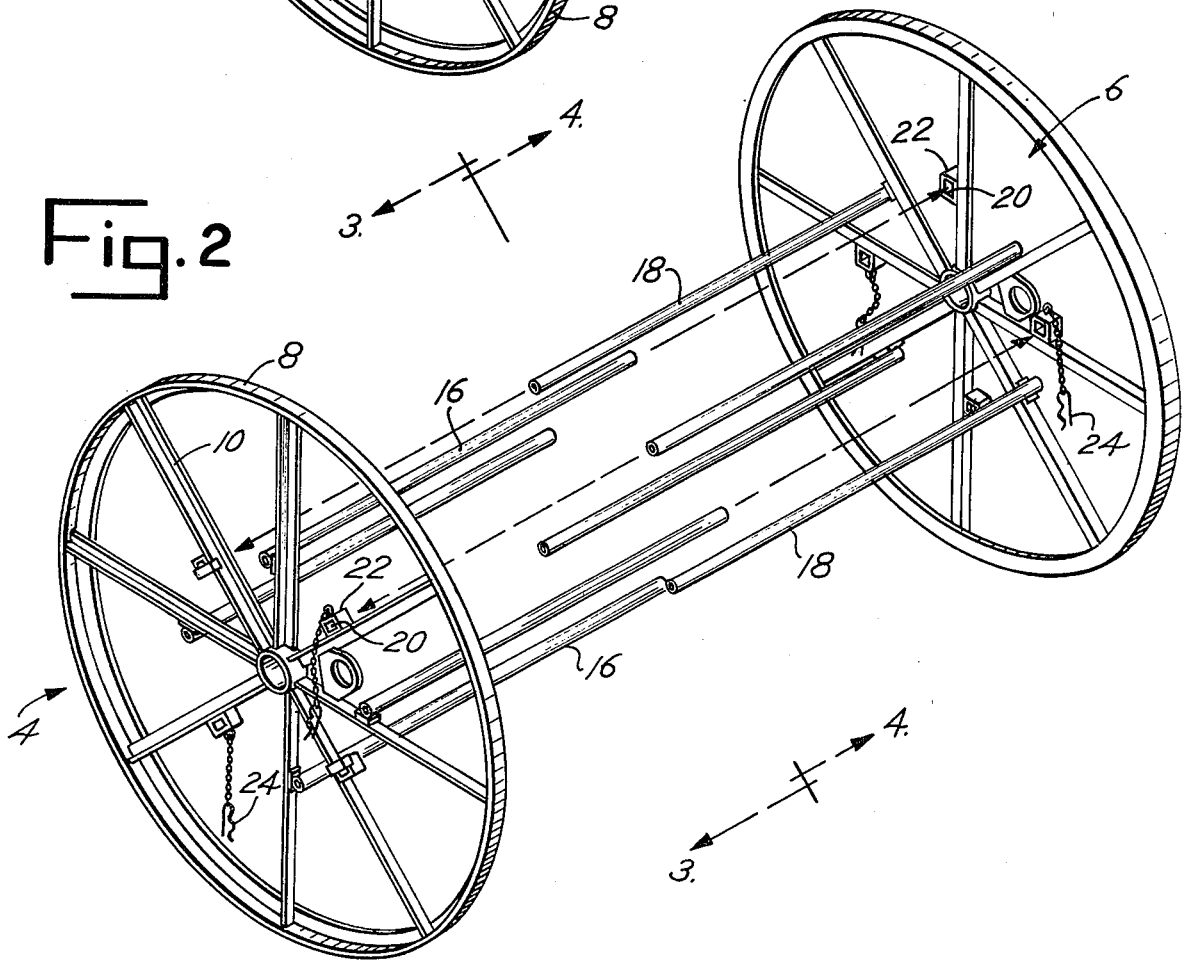
FIG. 2 is an exploded perspective view of the reel assembly illustrated in FIG. 1 showing the interrelationship of the component parts for assembly.

As jllustrated in detail in FIGS. 1 and 2, reel assembly 2 is very simply and easily assembled by placing the free end of tubes 16 into openings 20 in first side flange assembly 6 while simultaneously placing the free ends of tubes 18 in the openings 20 in second side flane assembly 4. Tubes 18 are then detachably connected to first side flange assembly 4 and tubes 16 detachably connected to second side flange assembly 6 by inserting cotter key 24 into aligned openings 27 of bracket 22 and openings 26 of the free end of the tube members.

Figure 7:
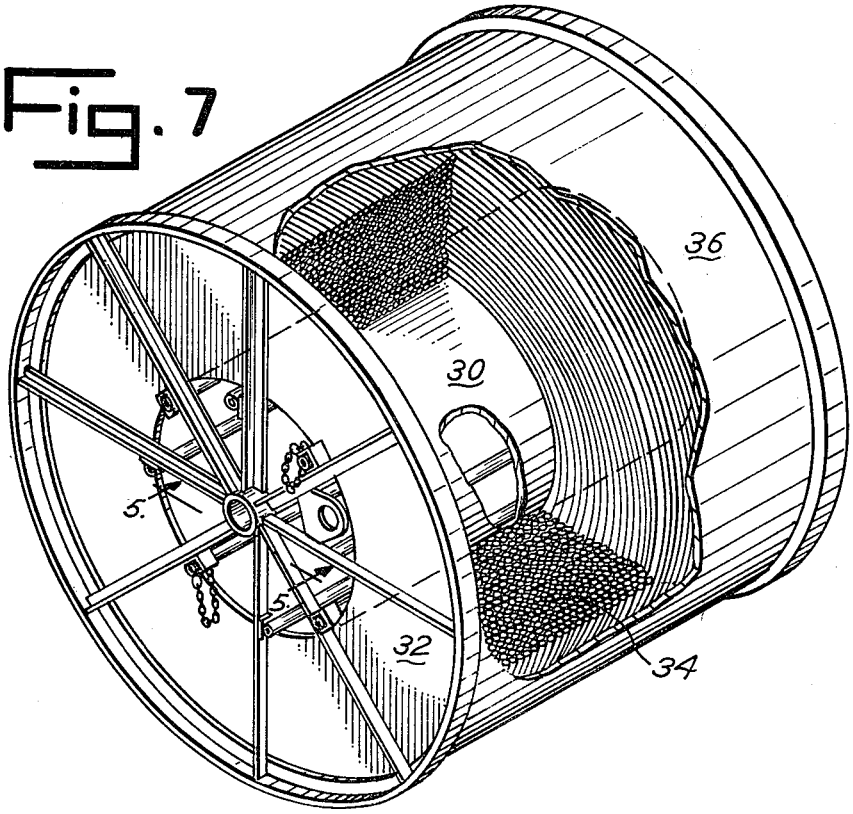
FIG. 7 is a partial cutaway perspective view of the reel assembly when loaded with cable for shipment.

When assembled, tubes 16 and 18 cooperate with each other to form a support surface or cage 28 (FIG. 1) upon which can be placed material to be transported and dispensed. As illustrated in FIG. 7, however, a flexible, preferably recycleable fiberboard sheet 30 is placed around support surface 28 before electrical conductor is placed on the reel assembly. Similarly, a sheet of fiberboard 32 is placed on the interior flange surfaces of first side flange assembly 4 and second side flange assembly 6. Recycleable fiberboard is preferred for purposes of cost and ecology. It is possible, however, to use any flexible sheet material including sheet metal and plastic on the tube and flange surfaces. Fiberboard sheets 30 and 32 cooperate to prevent any undue kinking or bending of the electrical conductor when it is wound on reel assembly 2. In addition, before the cable is shipped, a protective wrap of fiberboard 36 can be placed over electrical conductor 34 to protect the conductor from damage during transit.

Figure 6:
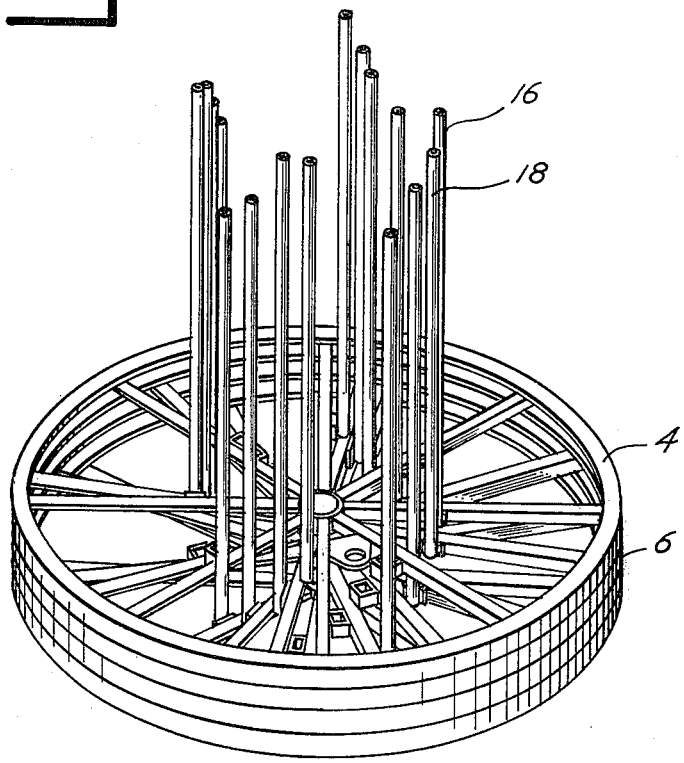
FIG. 6 illustrates the stacking or nesting characteristics of the component parts of the reel assembly.

A particularly advantageous feature of the reel assembly of the present invention is illustrated in FIG. 6. In this figure, the stacking or nesting ability of the component parts of the reel assembly when placed upon each other is illustrated. As specifically illustrated in FIG. 6, the parts necessary to form a member of reel assemblies (several pairs of side flanges) are superimposed on each other by permitting the support rods to pass through the spaces between the spokes in the side flanges so that the flanges can be stored in less space than required by one completed reel assembly. As a result, the reel assemblies can be very inexpensively returned to the manufacturer for re-assembly and further use in transporting and dispensing wire cable.

The specific 42 inch diameter commercial embodiment illustrated in FIGS. 1–7 weighs approximately 85 pounds. In contrast, a similar size prior art returnable steel or wooden reel weighs 300 pounds or more. A prior art non-returnable wooden drum weighs about 135 pounds. Accordingly, by a mere weight basis alone, it is easily seen that the reel assembly of the present invention can be very easily manipulated, moved and dismantled by a single person. More importantly, when returned, the reel assemblies of the present invention can achieve greater than a 50% space saving, further adding to the economic advantages of the present invention.

A particularly preferred embodiment has been illustrated in FIGS. 1–7. Alternative constructions are, however, within the generally broad scope of the present invention. For example, the left hand and right hand sie flange members can be made identical in form and structure by providing a centrally positioned opening in each spoke instead of the side position opening as illustrated in FIGS. 1–7. Alternately, a projection, preferably a bullet shaped projection, can be placed on the spokes to mate with the center of the support tubes. Similarly, it is possible to provide different size tubes on each flange member, one tube being slightly larger than the other in an amount sufficient to permit the tubes to telescope within each other. This construction would permit the manufacture of a reel assembly having various different traverses.

It is to be understood that the above described embodiments of the invention are merely illustrative of applications of the principles of this invention and that numerous other arrangements and modifications may be made within the spirit and scope of this invention.

I claim as my invention:

1. A lightweight, readily assembled and disassembled reel for transporting and dispensing material such as electrical conductor, said reel having an assembled condition and a disassembled condition, said reel, in the assembled condition comprising:

(i) a pair of first and second flange portions;

(ii) a plurality of spaced apart elongated support members of substantially equal length, some of said support members being permanently attached at one end to said first flange portion, other of said support members being permanently attached at one end to the second flange portion, said elongated support members being in an upright position relative to said flange portions;

(iii) means for quickly and detachably connecting the other ends of each of said elongated support members to the other of said flange portions;

(iv) said elongated support members when connected to said other flange portions and said pair of flange portions defining support means for the material being stored; and said reel, in said disassembled condition, comprising:

(i) said elongated support members being completely disconnected and free at the other ends from the flange portions;

(ii) said flange portions being positionable adjacent each other in a stacked configuration, with said elongated support members positioned to extend from the flange portions in the same direction through adjacent stacked flange portions and the other ends of said elongated members being in a laterally spaced relationship to each other.

2. An assembled reel according to claim 1 including a planar sheet of material around the elongated support members between the flange portions.

3. A reel section for forming a reel for cable by assembling first and second substantially identical reel sections, said section comprising in combination:

a flange member;

a plurality of permanently attached elongated rod members projecting transversely from the flange member;

the flange member including a central hub, a plurality of radially extending spokes projecting radially from the hub; said spokes spaced to define openings there between and a connecting circumferential rim on the perimeter of the flange member connecting the radially extending spokes, said hub, spokes, and rim defining a generally flat planar flange member;

the rod members including at least two parallel rod members permanently attached to separate spokes, projecting transversely from the flange member and attached to the flange member at a substantially equal radia distance from the center of the flange member, each rod member extending parallel to the other, of equal length to the other, and defining a distal end;

at least one of the rod members including a fastening means at the dista ends;

the flange member including means cooperative with the fastening means for maintaining pairs of the reel sections assembled in opposed relation with the flange members separated by the length of the rod members by fastening at least one of the rod members with the opposed flange member to maintain the sections together with the respective flange members forming the sides of a reel and the rod member forming the center cylindrical core of a reel; and a multiple number of the reels being stackable with the flange members resting one on top of the other and with the rod members projecting in the same direction through the space between the radial spokes of the stacked flanges to maintain the sections in interlocked, stacked relation separable by removing reel sections in the direction which the rod members extend.

* * * * *